US005168643A

United States Patent [19]

Laurain

[11] Patent Number: 5,168,643

[45] Date of Patent: Dec. 8, 1992

[54] SOUND ABSORBING SHOES

[76] Inventor: Larry G. Laurain, 37624 Willow Rd., New Boston, Mich. 48164

[21] Appl. No.: 659,632

[22] Filed: Feb. 25, 1991

[51] Int. Cl.[5] ..... A43B 13/00

[52] U.S. Cl. ..... 36/25 R; 36/113; 36/116

[58] Field of Search ..... 36/1 R, 132, 136, 1.5, 36/7.1 R, 116, 113, 62, 7.5

[56] References Cited

U.S. PATENT DOCUMENTS

| | | | |
|---|---|---|---|
| 1,266,492 | 5/1918 | Kurrell et al. | 36/116 X |
| 2,420,466 | 11/1947 | Hedman | 36/7.5 |
| 2,720,714 | 10/1955 | Krohn et al. | 36/116 X |
| 2,932,910 | 4/1960 | Brown | 36/7.5 X |
| 3,061,951 | 11/1962 | Barron | 36/1 X |
| 4,893,421 | 1/1990 | Folks | 36/132 |
| 4,896,439 | 1/1990 | Morgan | 36/116 X |

*Primary Examiner*—Steven N. Meyers
*Assistant Examiner*—Bethanne C. Cicconi
*Attorney, Agent, or Firm*—Alex Rhodes

[57] ABSTRACT

A hunter's shoe for concealing the presence of a hunter by absorbing airborne noises caused by the contact of the shoes with ground objects such as fallen branches, twigs and leaves. In the first aspect of the invention, a detachable sound absorber is combined with a conventional hunter's shoe. The sound absorber is comprised of a heel absorber, a sole absorber joined to the heel absorber, a flexible heel pad joined to the lower surface of the heel absorber and extending around the perimeter of the heel absorber, a flexible sole pad joined to the lower surface of the sole absorber and extending around the perimeter of the sole absorber; an ankle strap attached to the heel absorber and a toe strap attached to the sole absorber. The heel and sound absorber is comprised of rigid housings joined together by a flexible member and filled with a sound absorbing material. In the second aspect of the invention, a sound absorber is made integral with a hunter's shoe. The sound absorber comprises a sound absorbing material stored in the heel and sole of the shoe.

12 Claims, 3 Drawing Sheets

SOUND ABSORBING SHOES

BACKGROUND OF THE INVENTION

This invention relates generally to hunter's footwear, and more particularly to sound absorbing hunters' shoes.

Animals and birds have highly developed auditory systems which are capable of discerning unusual noises over long distances, especially sounds in the frequency range of 2,000 to 4,000 cycles per second (cps). Although hunting methods vary with the nature of the locality and the type of animal hunted, surprise is an important common element to the success of a hunter. Hunters attempt to surprise their game by hiding in trees or bushes. However, it is difficult for a mobile hunter to conceal his presence because of airborne noises caused by the contact of his shoes with ground objects such as fallen branches, twigs and leaves. Thus, airborne noises caused by a hunter's shoe limits a hunter's mobility and is a substantial handicap to the success of the hunter.

SUMMARY OF THE INVENTION

With the foregoing in view, it is one object of the invention to provide a means for reducing airborne noises caused by the contact of a hunter's shoe with ground objects such as fallen branches, twigs and leaves. Another object of the invention is to provide a noise reducing means which is readily adaptable to existing shoes.

One benefit of the invention is that it can also be used by police and servicemen to conceal their presence.

In the first aspect of the invention, the sound absorbing shoe is comprised of a conventional shoe and a sound absorber detachably mounted on the bottom of the shoe. The sound absorber is comprised of a heel absorber, a sole absorber joined to the heel absorber, a flexible heel pad joined to the lower surface of the heel absorber and extending around the perimeter of the heel absorber, a flexible sole pad joined to the lower surface of the sole absorber and extending around the perimeter of the sole absorber; an ankle strap attached to the heel absorber and a toe strap attached to the sole absorber. The heel and sound absorbers are filled with a highly porous material, such as a felted mineral fiber or an open cell polymer having a high sound absorption coefficient to dampen out sound waves caused by the contact of the shoe with ground objects.

In the second aspect of the invention, the sound absorber is integral with a hunter's shoe. Two embodiments of this aspect are disclosed. In one embodiment, the absorber is a fibrous material stored in a pocket of a combination heel and sole. In a second embodiment, the absorber is comprised of a plurality of channels in the combination heel and sole which are oriented and sized to absorb noise caused by the shoe.

Other objects and features of the invention will become apparent by reference to the ensuing description taken in connection with the accompanying drawings which describe the invention in detail.

DETAILED DESCRIPTION OF THE PREFERRED EMBODIMENT

Figure 2:
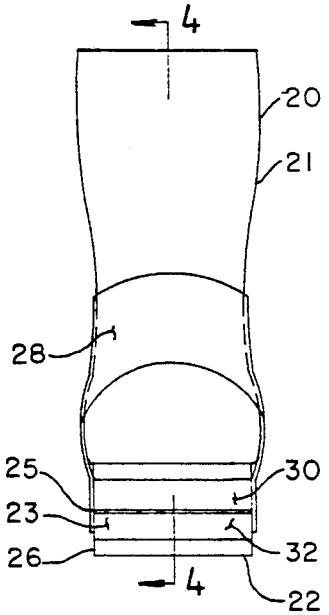
FIG. 2 is a rear view of the shoe and sound absorber shown in FIG. 1.
Figure 1:
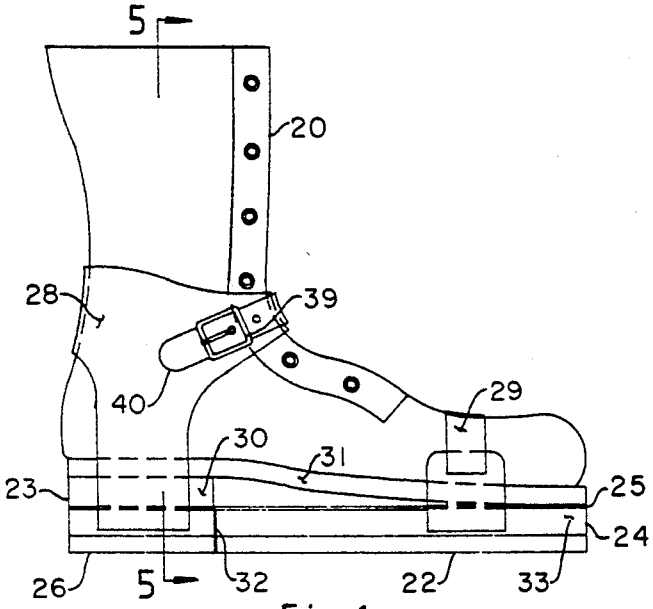
FIG. 1 is a side view of a hunter's shoe and a sound absorber detachably mounted on the shoe.
Figure 3:
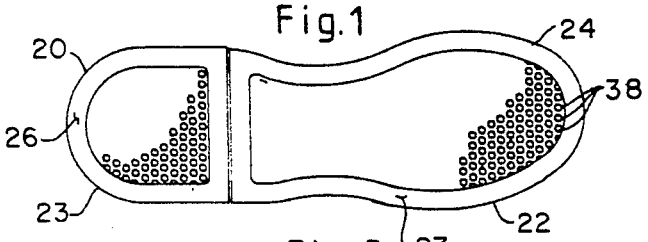
FIG. 3 is a bottom view of the shoe and sound absorber shown in FIG. 1.
Figure 5:
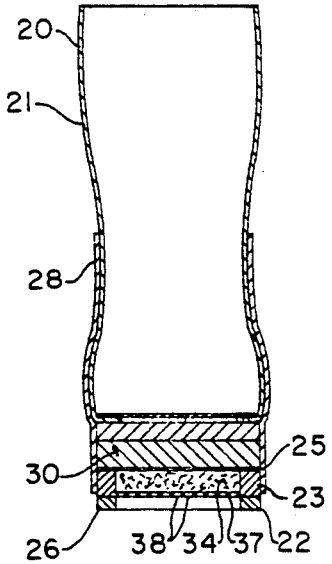
FIG. 5 is a cross-sectional view taken on the line 5—5 in FIG. 1.
Figure 4:
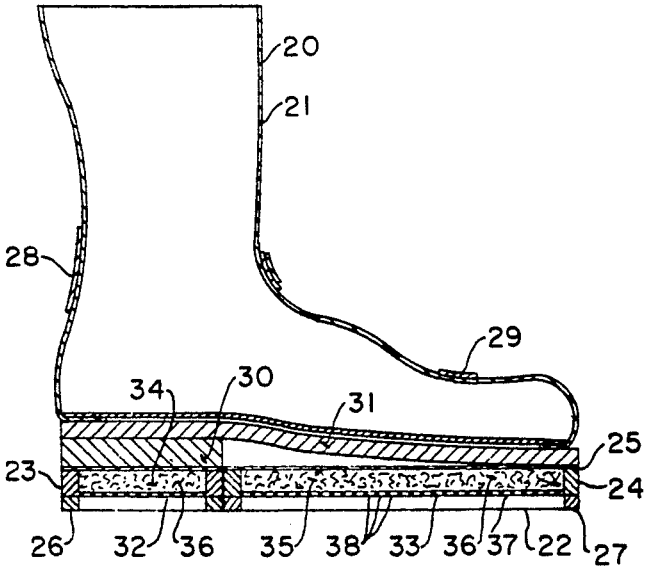
FIG. 4 is a cross-sectional view taken on the line 4—4 in FIG. 2.

Referring now to the drawings wherein like numerals refer to like and corresponding parts throughout the several views, an illustrative embodiment 20 is shown FIGS. 1 to 5, inclusive, which comprises a conventional hunter's shoe 21 and a contiguous sound absorber 22 detachably mounted to the bottom of the shoe 21. The sound absorber 22 includes a heel absorber 23; a sole absorber 24 joined to the heel absorber 23; a flexible member 25 for joining the heel absorber 23 to the sole absorber 24; a heel pad 26 below and extending around the perimeter of the heel absorber 23; a sole pad 27 below and extending around the perimeter of the sole absorber 24; an ankle strap 28 attached to the heel absorber 23; and a toe strap 29 attached to the sole absorber 24.

The heel 23 and sole 24 absorbers have a twofold purpose, namely, to reduce the breaking of ground objects such as twigs and to reduce noise caused by the trampling on objects such as twigs. The heel 23 and sole 24 absorbers are separate members which combine to cover the lower surfaces of the heel 30 and sole 31 of the shoe 21. The heel 23 and sole 24 absorbers are comprised of molded plastic housings 32, 33 with cavities 34, 35 filled with a highly porous material 36, such as an open cellular polymer or a mineral fiber having a low flow resistance and a high sound absorption coefficient. The flexible member 25 which joins the heel absorber 23 to the sole absorber 24 is attached to the upper surfaces of the heel 32 and sole 33 absorber housings. The member 25, a thin sheet of rubber or a flexible polymer such as polypropylene, also serves to retain the sound absorbing porous material 36 in the cavities 34, 35 when the sound absorber 22 is removed from the shoe 21.

The lower portions of the heel 32 and sole 33 absorber housings below the sound absorbing material 36 are thin walls 37 with a plurality of apertures 38. The apertures 38 provide an acoustical transparency to the housings 32, 33 which is required to allow the porous material 36 inside of the housings 32, 33 to dampen out sounds caused by the trampling on ground objects by the shoe 20.

The heel 26 and sole 27 pads are adhesively attached to the lower surfaces of the heel and sole absorber housings 32, 33 and are preferably made from a rubber-like cellular material to prevent the breaking of ground objects such as twigs.

The ankle strap 28 is a two part member consisting of a buckle portion 39 attached to one side of the heel absorber housing 32 and a tongue portion 40 attached to the opposite side of the heel absorber housing 32. The toe strap 29 is a flexible unitary member having end portions attached to opposite sides of the sole absorber housing 33.

The sound absorber 22 is mounted on the shoe 21 by engaging the shoe 21 with the toe strap 29 and thereafter joining together the buckle 39 and tongue 40 portions of the ankle strap with the hunter's foot.

Figure 7:
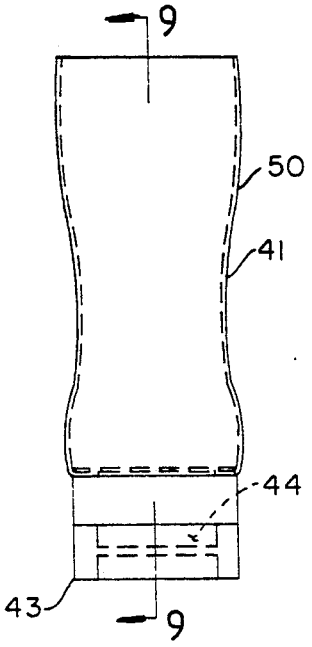
FIG. 7 is a rear view of the shoe shown in FIG. 6.
Figure 6:
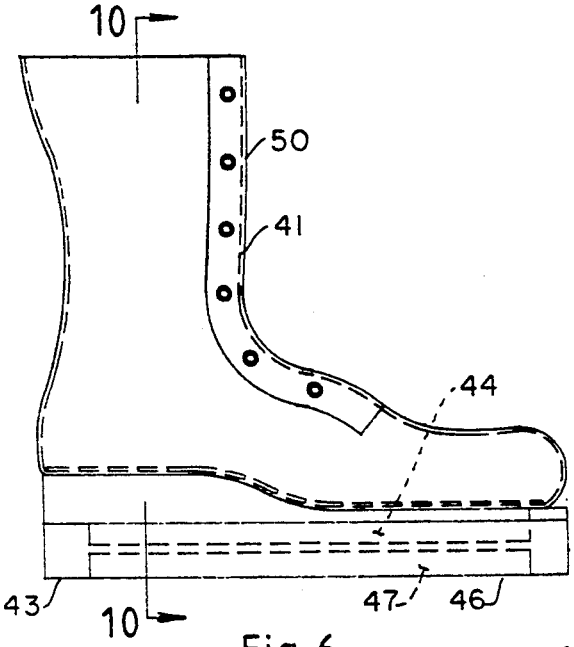
FIG. 6 is a side view of a hunter's shoe with a sound absorber which is integral with the shoe.
Figure 8:
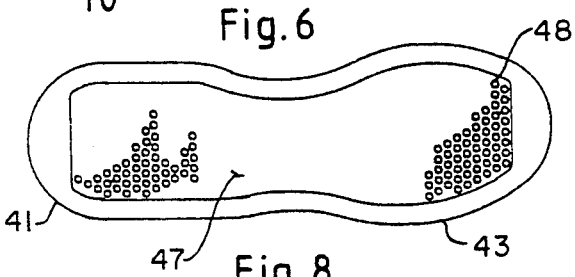
FIG. 8 is a bottom view of the shoe shown in FIG. 6.
Figure 10:
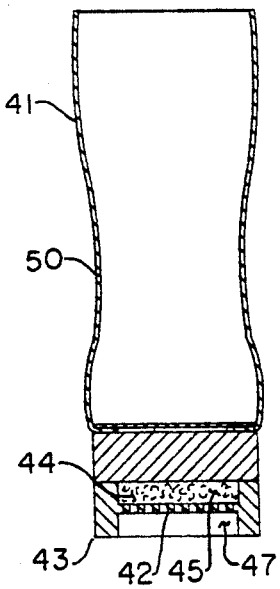
FIG. 10 is a cross-sectional view taken on the line 10—10 in FIG. 6.
Figure 9:
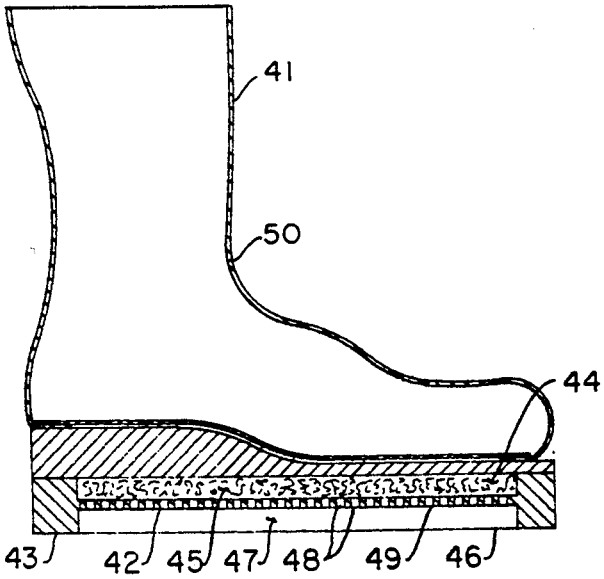
FIG. 9 is a cross-sectional view taken on the line 9—9 in FIG. 7.

With reference to FIGS. 6 through 10, inclusive, an alternate embodiment 41 is shown wherein a sound absorber 42 is an integral part of the hunter's shoe 41. The shoe 41 has a unitary heel and sole 43 molded of a rubber-like material. The upper portion of the heel and sole 43 is downward recessed to form a pocket 44 for storing a sound absorber 42 comprising a porous sound absorbing material and the lower portion of the unitary heel and sole 43 is upward recessed to form a narrow pad 46 extending around the perimeter of the heel and sole 43. The sound absorbing material 45 communicates with the upward recessed lower portion 47 of the heel and sole 43 through a plurality of apertures 48 in a thin wall 49 which separates the recessed upper 44 and lower 47 portions. The combined heel and sole 43 is attached to the upper portion 50 of the shoe by a conventional means such as an adhesive or sewing.

Figure 12:
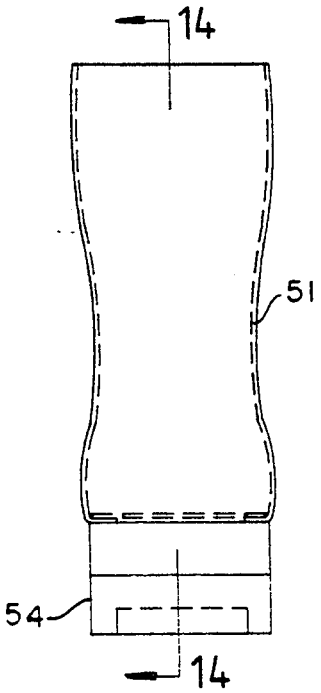
FIG. 12 is a rear view of the shoe shown in FIG. 11.
Figure 11:
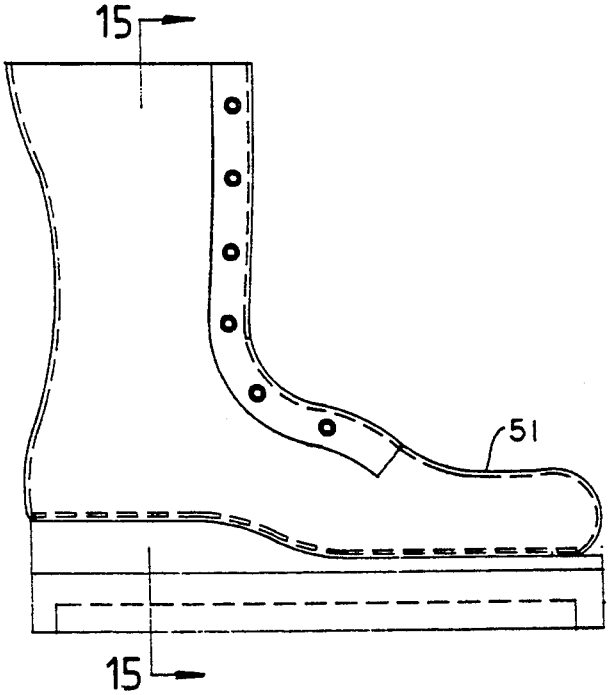
FIG. 11 is another embodiment of a hunter's shoe with a sound absorber which is integral with the shoe.
Figure 13:
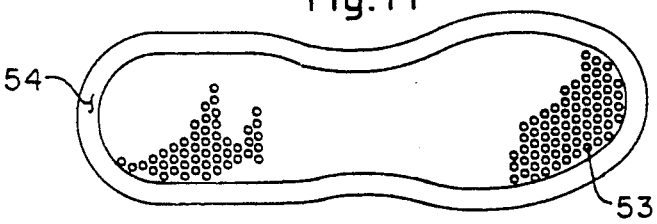
FIG. 13 is a bottom view of the shoe shown in FIG. 11.
Figure 15:
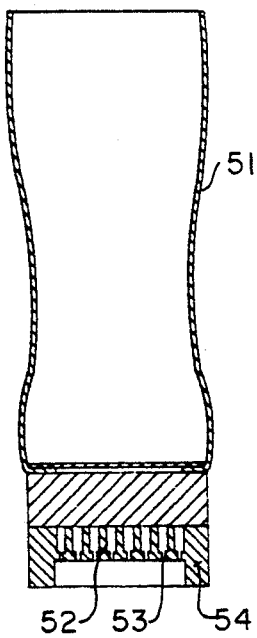
FIG. 15 is a cross-sectional view taken on the line 15—15 in FIG. 11.
Figure 14:
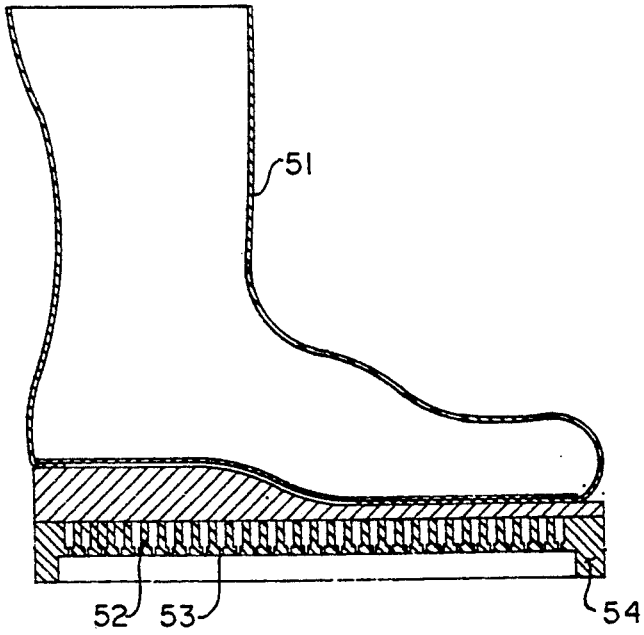
FIG. 14 is a cross-sectional view taken on the line 14—14 in FIG. 12

In FIGS. 11 to 15, inclusive, an embodiment 51 is shown which is similar to the embodiment 41 of FIGS. 6 through 10, except that the sound absorber 45 is replaced by a plurality of small diameter tubular channels 52 with reduced diameter entrance apertures 53. The tubular channels 52 extend vertically upward from the lower surfaces of the unitary heel and sole 54 and function as resonance absorbers for reducing noise when the shoe tramples on ground objects such as branches and twigs.

From the foregoing it will be understood that my invention provides a means for concealing the approach of a hunter by absorbing sounds caused by the contact of the hunter's shoes with objects such as fallen branches or leaves. Moreover, my invention can also be used by others, including police and servicemen.

Although but several embodiments of my invention have been illustrated and described, it is obvious that many changes may be made in the size, shape, arrangement and materials of their elements without departing from the scope of the invention defined by the appended claims, it being understood that the disclosure and drawings shall be interpreted in an illustrative and not a limiting sense.

I claim:

1. A sound absorbing hunter's shoe for concealing the presence of a hunter comprising: an upper portion for covering a foot of a hunter, said upper portion having a lower surface which underlies the lower surface of said foot of said hunter; a sound absorbing lower portion extending below said foot covering upper portion for absorbing sounds caused by the contact of said shoe with ground objects including branches, twigs and leaves, said sound absorbing lower portion below said upper portion comprising a sound absorbing means having a high sound absorption coefficient which and substantially covers said lower surface of said upper portion, a rigid annular portion surrounding said sound absorbing means and an acoustical transparent apertured portion below said sound absorbing means, and a narrow flexible annular portion extending below and around the perimeter of said apertured portion for preventing the breaking of said branches, twigs and leaves.

2. The sound absorbing hunter's shoe recited in claim 1 wherein said sound absorbing lower portion is detachably retained to said foot covering upper portion.

3. The sound absorbing hunter's shoe recited in claim 1 wherein said sound absorbing lower portion is fixedly attached to said foot covering upper portion.

4. The sound absorbing hunter's shoe recited in claim 1 wherein said means for absorbing sound is a layer of a mineral fiber.

5. The sound absorbing hunter's shoe recited in claim 1 wherein means for absorbing sound is a layer of an open cell polymer.

6. The sound absorbing hunter's shoe recited in claim 1 wherein said means for absorbing sound comprises a plurality of resonance absorbers, said resonance absorbers comprising a plurality of small diameter tubular channels with reduced diameter entrance apertures, said tubular channels extending vertically upward, said reduced diameter entrance apertures and portions therebetween forming said acoustical transparent apertured portion below said sound absorbing means.

7. The sound absorbing hunter's shoe recited in claim 2 further comprising a means for detachably retaining said sound absorbing lower portion to said foot covering upper portion, said retaining means comprising an ankle strap and an toe strap.

8. A sound absorbing hunter's shoe for concealing the presence of a hunter comprising: an upper portion for covering a foot of a hunter, said upper portion having a heel portion and a sole portion which underlies the lower surface of said foot of said hunter; a sound absorbing lower portion detachably mounted to said foot covering upper portion, said lower portion comprising a heal absorber having a high sound absorption coefficient and a sole absorber having a high sound absorption coefficient and joined to said heel absorber, said heel and said sole absorbers having separate housings, each of said housings having a downward recessed center portion for housing a sound absorbing material and a thin acoustically transparent perforated lower portion; a flexible member for joining the heel absorber to the sole absorber; an ankle strap attached to the heel absorber; and a toe strap attached to the sole absorber.

9. The sound absorbing hunter's shoe recited in claim 8 wherein said flexible member for joining said heel absorber to said sole absorber is a thin sheet of a flexible polymer.

10. The shoe as recited in claim 8 further comprising a first annular resilient pad attached to and extending below said heel absorber housing; and a second annular resilient pad attached to and extending below said sole absorber housing.

11. The shoe as recited in claim 8 further comprising a layer of sound absorbing fibrous material in said recessed central portions of said heel absorber and said sole absorber.

12. A sound absorbing hunter's shoe for concealing the presence of a hunter comprising: an upper portion which is adapted to cover a foot of a hunter, said upper portion having a lower surface which underlies the lower surface of said foot of said hunter; a sound absorbing lower portion attached to said foot covering upper portion, said lower portion including a plurality of resonance absorbers, said resonance absorbers comprising a plurality of smaller diameter tubular channels with reduced diameter entrance apertures, said tubular channels extending vertically upward from a lower surface of said sound absorbing lower portion for absorbing sound which substantially covers said lower surface of said upper portion; and a means for retaining said sound absorbing layer in said lower portion, said means having an annular outer portion below said sound absorbing layer and extending around the perimeter of said lower portion.

* * * * *